US007020989B2

(12) United States Patent
Kim

(10) Patent No.: US 7,020,989 B2
(45) Date of Patent: Apr. 4, 2006

(54) SHOES HAVING IMPROVED ANKLE SUPPORT

(76) Inventor: Sung-Yeol Kim, 91-20 Gajwa-Dong, Ilsan-Gu, Goyang-Do (KR) 411-440

( * ) Notice: Subject to any disclaimer, the term of this patent is extended or adjusted under 35 U.S.C. 154(b) by 83 days.

(21) Appl. No.: 10/667,080

(22) Filed: Sep. 18, 2003

(65) Prior Publication Data

US 2004/0088887 A1 May 13, 2004

(30) Foreign Application Priority Data

Oct. 29, 2002 (KR) ..... 20-2002-0032259

(51) Int. Cl.
*A43B 7/20* (2006.01)

(52) U.S. Cl. ..... 36/89; 36/127

(58) Field of Classification Search ..... 36/89, 36/90, 136, 127, 58
See application file for complete search history.

(56) References Cited

U.S. PATENT DOCUMENTS 534,179 A * 2/1895 Sessler ..... 36/89
737,959 A * 9/1903 Posner ..... 36/89
1,210,255 A * 12/1916 Altschul ..... 36/89
4,726,126 A * 2/1988 Bernhard ..... 36/89

FOREIGN PATENT DOCUMENTS

CH 662483 * 7/1984

* cited by examiner

*Primary Examiner*—Ted Kavanaugh
(74) *Attorney, Agent, or Firm*—Jerry H. Noh

(57) ABSTRACT

A shoe having ankle support for preventing an unwanted ankle movement during a predetermined activity comprises a support piece having an ankle support and legs extending downwardly from the ankle support where the legs are removably inserted down in a pocket formed on an outer surface of an ankle side shoe portion. The shoe further comprising a heal support pad embedded in the foot cover member extending around the heel of a wearer, a cap covering the ankle support of the support piece, and a cover band extending over each pocket and cap to secure the cap.

2 Claims, 6 Drawing Sheets

SHOES HAVING IMPROVED ANKLE SUPPORT

BACKGROUND OF THE INVENTION

I. Field of Invention

This invention relates to shoes. More particularly, the present invention relates to shoes having an ankle portion formed for improved ankle support and for control of unwanted ankle movement.

II. Description of the Prior Art

Conventional shoes have a sole to support the bottom of the wearer's foot and a foot cover member attached thereto to cover the wearer's foot. Shoes conventionally come in two forms, low cut versions and high top versions. In low cut versions, the foot cover portion extends to just below the wearer's bulging ankle bone. In high top versions, the foot cover member extends upward to cover the wearer's bulging ankle bone.

High tops are often worn because they provide ankle support that low cut types of shoes lack. However, high tops themselves provide a relatively low amount of ankle support. This low amount of ankle support may be suitable for players in sports such as basketball and football, which requires a lot of quick cutting movement. However, in sports such as golf, a higher degree of ankle support can be required for improved performance. A shoe having a high degree of ankle support can be worn in golf since there is relatively limited amount of foot movement necessary when playing.

Golf shoes are known for having spikes protruding from the bottom surface for gripping the surface of the playing surface. However, one of the disadvantages of the conventional golf shoe is limitation in ankle control. An abruptly strengthened golf swing has a tendency to lead to an unwanted ankle shift or twist which may result in a poor swing and even an ankle joint injury.

As such, in an activity or sport requiring a relatively high amount of ankle support, such as golf, a shoe as taught in the present invention is desirable.

SUMMARY OF THE INVENTION

The present invention is contrived to overcome the conventional disadvantages. Accordingly, it is an object of the present invention to provide a shoe having a relatively high amount of ankle support. Additionally, it is another object of the present invention to provide a shoe having a relatively high amount of ankle support which is comfortable for use in sports such as golf. It is yet another object of the present invention to provide a shoe which can be worn in playing golf to prevent an unwanted ankle movement during a club swing.

To achieve these objects, the shoe of the present invention has an insertable support piece having an ankle support and legs extending downwardly from the ankle support. The legs are removably inserted down into a pocket formed on both sides of the foot cover member of the shoe at the portions corresponding to a wearer's ankle. A U-shaped support pad is embedded in the rear portion of the foot cover member to extend around a wearer's heel. In addition, a cap is provided to cover the ankle support of the support piece, and a cover band is provided on each side of the shoe to firmly hold the support piece in the desired place.

In a second embodiment of the present invention, the shoe has a padded support sleeve attached to each side of the foot cover member corresponding to the wearer's ankle. Each support sleeve has a lower portion attached to the foot cover member and an upper portion where a vertical opening is formed from atop thereof and extends through the lower portion. A first support piece is removeably inserted into each support sleeve. Each first support piece has an ankle support and legs extending downwardly from the ankle support. The legs are removably inserted in the vertical openings and the ankle support covers a user's anklebone.

Although the present invention is briefly summarized, the full understanding of the invention can be obtained by the following drawings, detailed description and appended claims.

BRIEF DESCRIPTION OF THE DRAWINGS

These and other features, aspects and advantages of the present invention will become better understood with reference to the accompanying drawings, wherein.

DETAILED DESCRIPTION OF THE PREFERRED EMBODIMENTS

Figure 1:
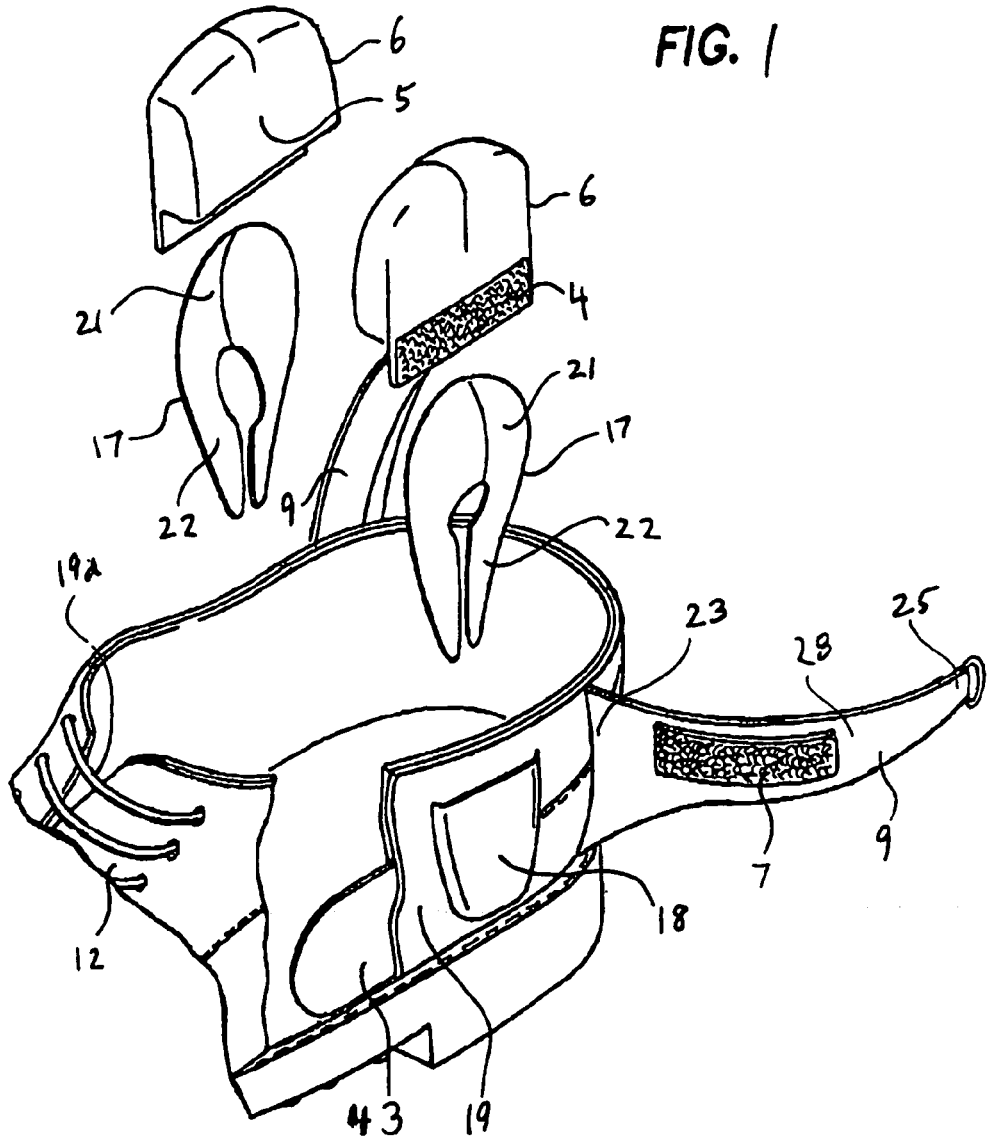
FIG. 1 is an exploded view showing construction of a golf shoe according to the present invention.

With reference to the accompanying drawings, a shoe according to the present invention will now be described. As shown in FIG. 1, the shoe 20 includes a sole 15 attached to a foot cover member 19, and a plurality of lace holes 11 extends in two front rows on the front portion 12 of the foot cover member 19. A pocket 18 is formed on each side of the foot cover member 19 at the portion corresponding to a wearer's ankle. Each pocket 18 has a top opening for insertion of a support piece 17 into the pocket 18 from above. Each support piece 17 has an ankle support 21 and legs 22 downwardly extending from the ankle support 21 serving to support the wearer's anklebone. Here, the legs 22 of the support piece 17 are inserted into the pocket 18 whereas the ankle support 21 of the support piece 17 remains out of the pocket 18 while covering the user's ankle. A cap 6 is provided to cover the ankle support 21 of the support piece 17.

The shoe 20 of the present invention, as shown in FIG. 1, further has a support pad 43 formed into the lower rear portion of the foot cover member that is U-shaped to surround the wearer's heel thereby allowing the wearer to maintain a stabilized posture during an activity. Also, a cover band 9 is formed on each side of the foot cover member 19. Each cover band 9 has a first end 23 connected to the foot cover member 19 behind a corresponding pocket 18 and a second end 25 having an engagement member 8 thereon. Each cover band 9 is sized and placed on the foot cover member 19 to extend over a corresponding pocket 18 and towards the front portion 12 of the shoe 20.

The cap 6 includes a sponge portion 5 that provides cushion between the user's ankle and the ankle support 21 of the support piece 17. In this construction, to wear the cap 6 over on the support piece 17, the ankle support 21 of the support piece 17 is inserted in the opening 6*a* of the cap 6. The cap 6 further includes a first band of fastening means 4 that matches with a second band of fastening means 7 on inner surface 28 of the cover band 9. The fastening means may be alternately formed in hook fastening members and loop fastening member piles as shown in the illustrations. In the alternative, the fastening means can be alternately formed in snap and button (not shown).

When the cover band 9 is covered over the pocket 18 that has the legs of the anide support 17 therein and the fastener means 4 thereon, the second fastening means 7 of the band 9 becomes detachably attached to the first fastener means 4 of the cap 6. Here, the cover band 9 together with the support pad 43 of the shoe serves to support the wearer's heel while propping the wearer's anide and anklebone.

Figure 3:
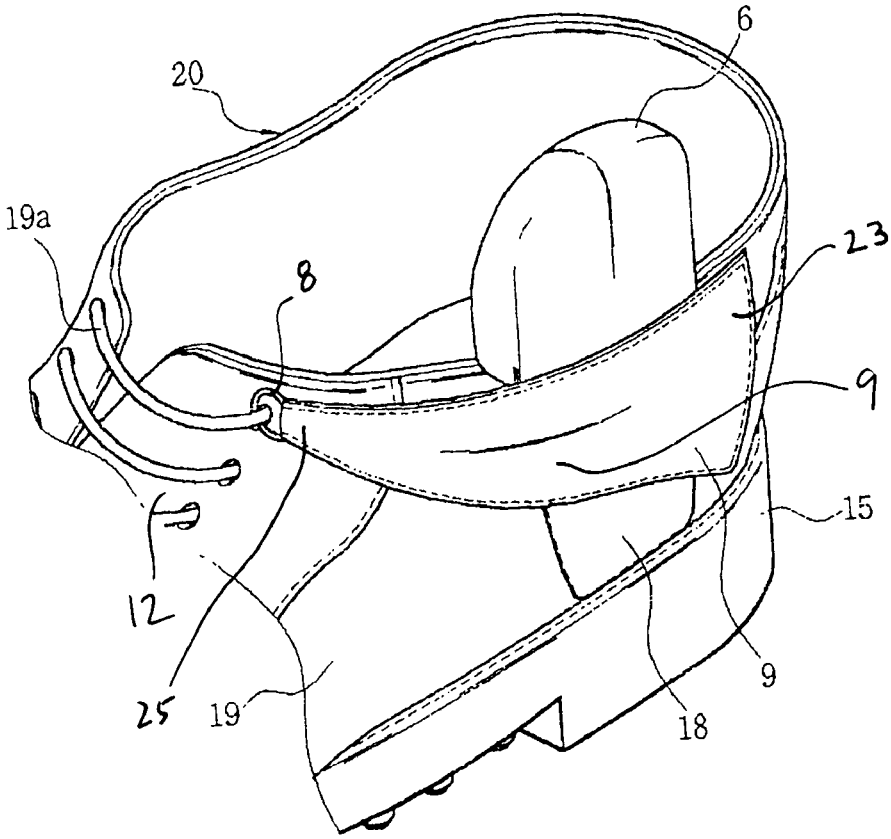
FIG. 3 is a perspective view showing the assembled shoe.

In the embodiment shown in FIG. 3, the first end 23 of the cover band 9 is fixed to the foot cover member near the heel side of the shoe and the second end 25 of the cover band 9 has an engagement ring 8 attached thereto for engagement by a shoe string 19*a*. That is, the second fastening means 7 of the cover band 9 is detachably attached to the first fastening means 4 of the cap 6, and the engagement ring 8 formed on the second end 25 of the cover band 9 is hooked by the shoe string 19*a*, thereby realizing a stabilized additional propping to the wearer's ankle and anklebone. In the alternative (not shown), the second end of the cover band 9 can simply have an engagement member which is an opening formed therethrough sufficient for passage of a shoe lace.

Figure 2:
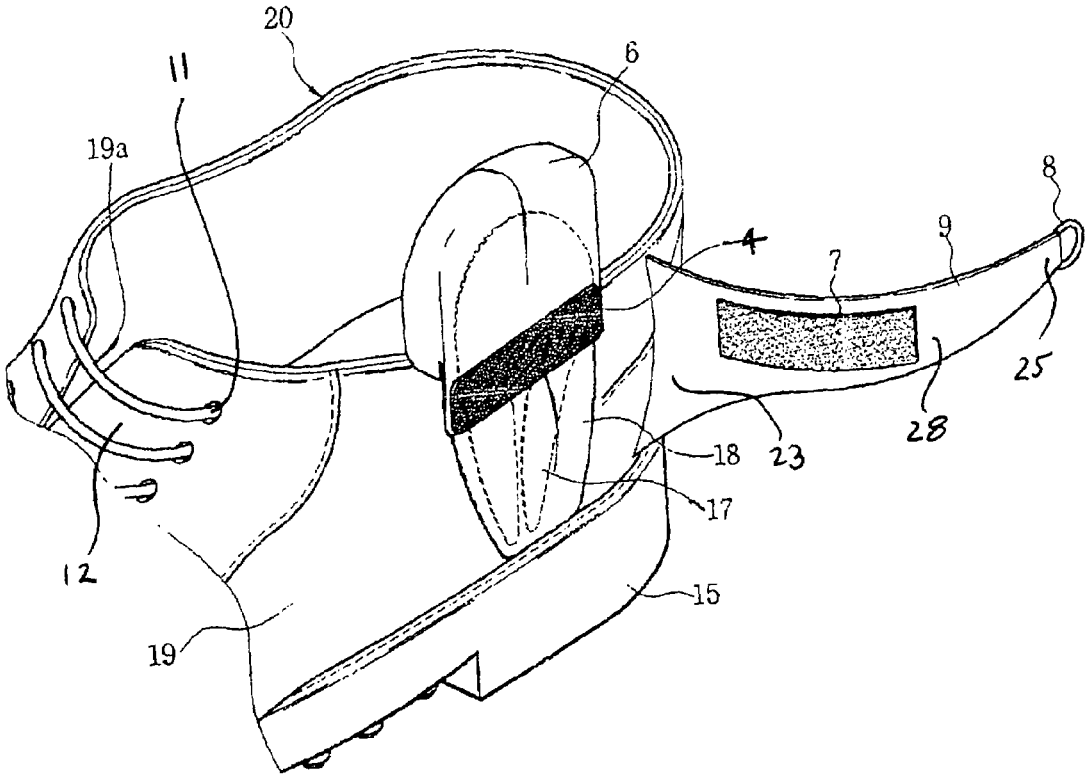
FIG. 2 is a perspective view showing assembly of a support piece and a cap to the shoe.

As shown in FIGS. 2 and 3, the legs of the support piece 17 are inserted into the pocket 18, and the cap 6 is worn over on the ankle support of the support piece 17 so that the sponge portion 5 becomes placed between the wearer's anklebone and the ankle support 21 of the support piece 17, and then the cover band 9 is covered over the pocket 18 with the second fastening means 7 attached to the first fastening means 4. This ankle and anklebone support mechanism is competed by hooking the engagement ring 8 by the shoe string 19*a*, thereby stably supporting the wearer's ankle and anklebone while preventing the support piece 17 from being released from the pocket 18 during movement by the wearer.

As discussed above, the removably provided support piece 17 along with the support pad 43 embedded between surfaces of the shoe prevents an unwanted ankle movement or twisting during club swing, thereby improving club swing accuracy and maximizing product satisfaction.

Figure 4:
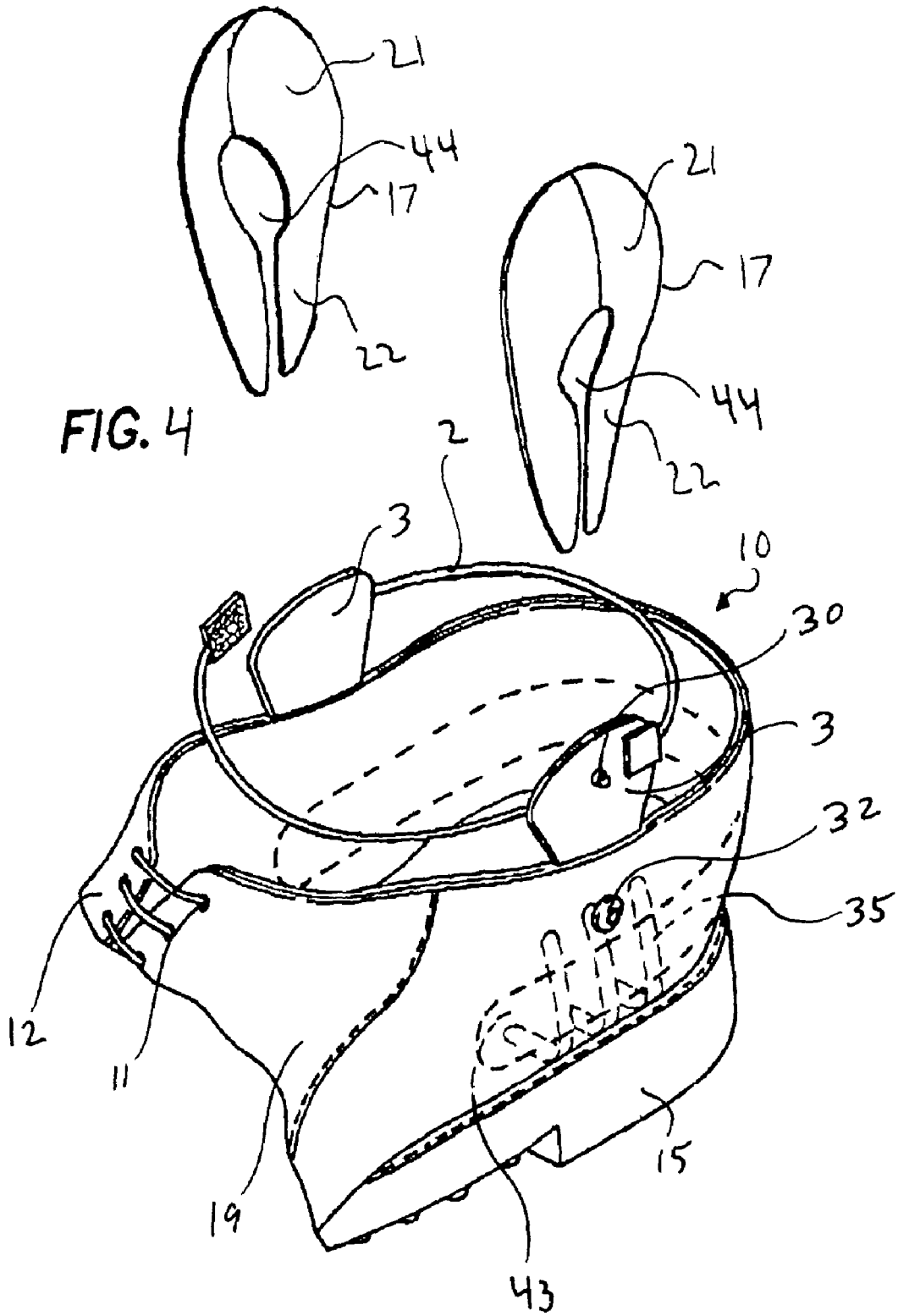
FIG. 4 is a partial exploded perspective view of a second embodiment of the present invention.
Figure 5:
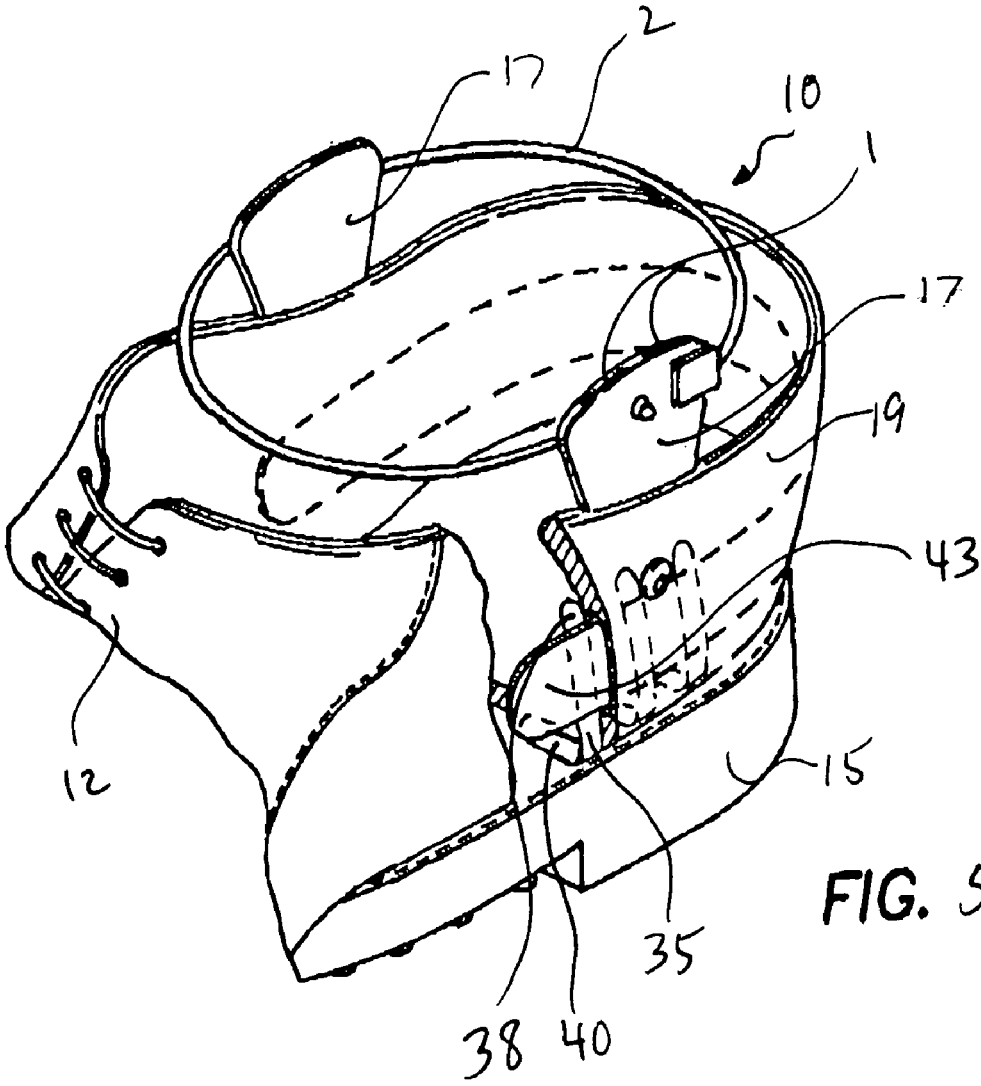
FIG. 5 is a construction view of the second embodiment of the present invention.
Figure 6:
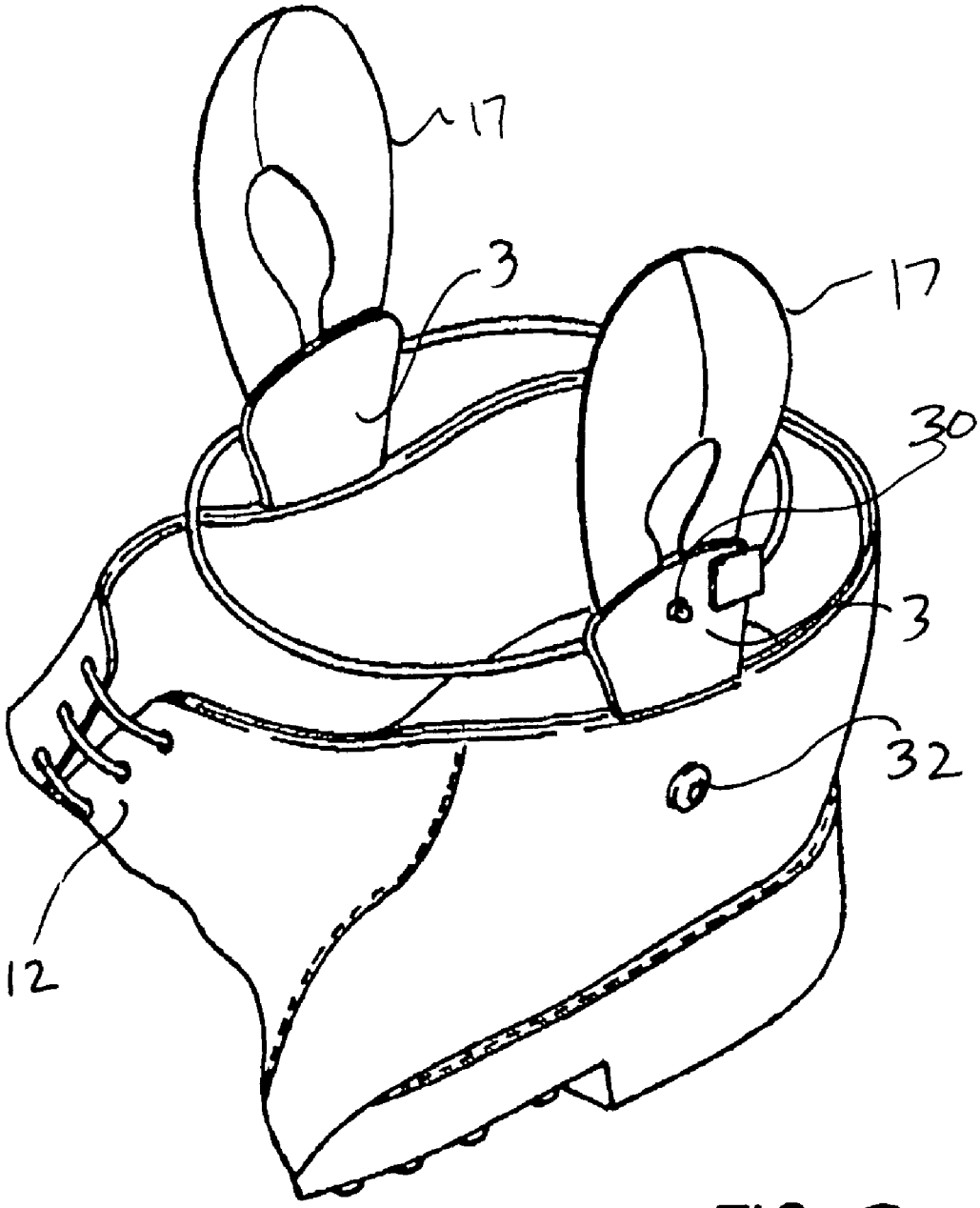
FIG. 6 is a perspective view showing insertion of the first support piece according to the second embodiment of the present invention.

A second embodiment of the present invention is illustrated in FIGS. 4 to 6. As shown, the second embodiment comprises a shoe 10 having a sole 15 attached to a foot cover member 19, and a plurality of lace holes 11 extends in two front rows on the front portion 12 of the foot cover member 19. A support sleeve 3 is disposed on each side of the foot cover member 19 at the portion corresponding to a wearer's ankle area. Each support sleeve 3 has a top opening for vertical insertion of a first support piece 17 therein. The support sleeve 3 can be padded and is attached so that without the first support pierce 17 therein, at least the top half bends outwardly over to become detachably attached on the side ankle area of the foot cover member 19.

In the construction shown in the FIGS. 4 to 6, the support sleeve 3 is placed into the foot cover member 19. Also, in the illustrated construction, the support sleeve 3 attaches to the foot cover member 19 by a snap 30 and button 32. In the alternative (not shown), the support sleeve 3 can be attached to the foot cover member 19 by use of bands of hook and loop fasteners (not shown).

The second embodiment of the shoe further includes a plurality of L-shaped second support pieces 35 embedded in the shoe 10 extending from the foot cover portion 19 and to the sole 15. The second support pieces 35 are placed in the area corresponding to the lower ankle area of the wearer's foot. Each second support piece 35 has an upper portion 38 embedded in the foot cover member 19 and a lower portion 40 planted in the sole 15. The second support piece 35 provides an additional elasticity and is preferably formed in plural. The second support pieces 35 may be formed in a slightly hooked configuration in the alternative. In order to fabricate the second support piece 35, a compound resin with high strength is cut out preferably with a thickness of about 1.0 to 1.5 millimeters and a width of about 1.0 centimeter and then crooked in "L" shape.

The first support piece 17 as shown in FIG. 4 includes an ankle support 21 and legs 22 extending downward from the ankle support. A slot opening 44 is formed between the legs 22. The legs 22 are formed preferably slimmer or narrower toward each lower tip of the legs 22. It is desirable to have the first support piece 17 formed of a compound resin with high strength to reserve elasticity while preventing unwanted ankle movement during a movement of the wearer. The ankle support 21 is formed to fittingly surround a user's anklebone. A band 2 is formed through the upper portion of the support sleeve 3 and around a user's ankle to maintain the support sleeve 3 raised when required. In this construction, the legs 22 of the first support piece 17 are detachably inserted into the openings 1 of the support sleeve whereas the ankle support 21 of the first support piece 17 remains exposed while covering the wearer's ankle. As shown in FIG. 6, the second support piece 35 together with the first support piece 17 serves to prop the user's ankle. For additional ankle support, the second embodiment can further include a U-shaped heel support pad 43 embedded in the lower rear portion of the foot cover member, which is sized and shaped to extend around a wearer's heel.

In proper use of the second embodiment, each support sleeve 3 is raised to be vertical and the legs 22 of each first support piece 17 are inserted into the corresponding openings 1 of the support sleeve 3 such that the ankle support 21 safely of each first support piece 17 covers the corresponding side of the user's anklebone. Thereafter, the band 2 is tied around the user's ankle. Consequently, the user's ankle and anklebone are stably supported by the first and second support pieces 17, 35 to prevent unwanted ankle movement or twisting and maintain a stabilized posture in a predetermined activity.

Although the invention has been described in considerable detail with reference to certain preferred versions thereof, other versions are possible by converting the aforementioned construction. Therefore, the scope of the invention shall not be limited by the specification specified above and the appended claims.

What is claimed is:

1. In a shoe having a sole, a foot cover member attached to said sole, a plurality of lace holes extending in two front rows on the front portion of the foot cover member, with the improvement comprising:

a pocket formed on each side of the foot cover member at a portion corresponding to the portion of a wearer's ankle;

a support piece removeably inserted into each pocket, said support piece having an ankle support and legs downwardly extending from the ankle support, said support piece being of a predetermined stiffness necessary to support the wearer's anklebone for preventing an unwanted ankle movement during a predetermined activity;

a cap for covering each ankle support of the support piece, said cap having an inner side corresponding to the side facing the wearer's ankle, said cap having a padding formed on said inner side thereof;

a cover band disposed on each side of the foot cover member, each cover band having a first end connected to the foot cover member behind a corresponding pocket, each cover band having a second end having an engagement member; and, each cover band being of a sufficient length to extend over a corresponding pocket and to the front portion of the shoe.

2. The shoe as described in claim 1 further comprising:

a first band of loop fastening member disposed on the outer surface of each cap;

each cover band having a second band of hook fastening members disposed on an inner surface thereof for engagement with a corresponding first band of loop fastening member as each cover band extends over a corresponding pocket to the front portion of the shoe.

* * * * *